US006368128B1

(12) United States Patent
Bäcker et al.

(10) Patent No.: US 6,368,128 B1
(45) Date of Patent: Apr. 9, 2002

(54) ELECTRICAL PLUG-IN CABLE CONNECTOR WITH SHORT-CIRCUIT BYPASS

(75) Inventors: Arnd Bäcker, Hellenthal; Michael Degenhardt, Kall-Sötenich; Ralf Kupp, Schleiden, all of (DE)

(73) Assignee: Stocko Contact GmbH & Co. KG (DE)

( * ) Notice: Subject to any disclaimer, the term of this patent is extended or adjusted under 35 U.S.C. 154(b) by 0 days.

(21) Appl. No.: 09/606,322

(22) Filed: Jun. 28, 2000

(30) Foreign Application Priority Data

Jun. 28, 1999 (DE) ..... 299 10 867 U

(51) Int. Cl.[7] ..... H01R 29/00
(52) U.S. Cl. ..... 439/189
(58) Field of Search ..... 439/189, 507, 439/509, 510, 511, 512, 513

(56) References Cited

U.S. PATENT DOCUMENTS

| | | | | |
|---|---|---|---|---|
| 4,456,317 A | * | 6/1984 | McCleerey | 439/507 |
| 5,061,196 A | * | 10/1991 | Weston et al. | 439/507 |
| 5,626,492 A | * | 5/1997 | Onizuka et al. | 439/512 |
| 5,660,563 A | * | 8/1997 | Chevarie et al. | 439/512 |
| 5,788,519 A | | 8/1998 | Stern | |

FOREIGN PATENT DOCUMENTS

| | | |
|---|---|---|
| EP | 0 307 580 A2 | 3/1989 |
| EP | 0 387 722 A1 | 9/1990 |
| EP | 0 634 819 A2 | 1/1995 |

* cited by examiner

*Primary Examiner*—Neil Abrams
*Assistant Examiner*—Thanh-Tam Le
(74) *Attorney, Agent, or Firm*—R. W. Becker & Associates; R. W. Becker

(57) ABSTRACT

An electrical plug-in cable connector having contact elements that are arranged in a row in chambers of a plastic housing is provided. In the longitudinal direction, each contact element has on one side a first connecting segment, in particular insulation displacement contacts for bare connection of a cable, and on their opposing side a second connecting segment, in particular a flexible tongue pair for connecting a plug contact pin or a conductor strip. A short-circuit bypass is provided between two contact elements. Formed in the connection region of the contact element between the two connecting segments, in particular between the insulation displacement contact elements and the flexible tongue pair, is a recess that is laterally accessible. The recesses of at least two of these contact elements are interconnected by inserting an electrically conducting bypass element in the transverse direction to produce the short-circuit bypass. The bypass element is arranged in the recesses with press fit.

6 Claims, 5 Drawing Sheets

ELECTRICAL PLUG-IN CABLE CONNECTOR WITH SHORT-CIRCUIT BYPASS

BACKGROUND OF THE INVENTION

The invention relates to an electrical plug-in cable connector having contact elements that are arranged in a row in chambers of a plastic housing and that, seen in the longitudinal direction, each have on their one side a first connecting segment, in particular insulation displacement contacts for bare connection of a cable, and that each have on their opposing side a second connecting segment, in particular a flexible tongue pair for connecting a plug contact pin, whereby a short-circuit bypass is provided between two contact elements.

An electrical cable connector of this type is known from DE-OS 38 04 950. Electrical contact elements are arranged in a row in a plastic housing and ae embodied as reed contacts, whereby the corresponding printed tracks or conductor strips are contacted in insulation displacement technology with each of the contact springs. Such a connector can, e.g., be attached to the edge of a printed circuit board in order to be able to produce by means of the printed tracks the electrical connection to the electronic components arranged on the printed circuit board. However, it is also possible to attach the connector to a special plug connector. In different applications it is desirable in such connectors to provide two or more electrical contact elements with a short-circuit bypass. It can be necessary either to bypass electrical contact elements that are mutually immediately adjacent or to bypass desired electrical contact elements within the row so that individual electrical contact elements are skipped. Known is using an electrically conducting bypass element that is essentially U-shaped and that can be attached from above thereto with each of its two legs on the electrical contact elements and that after being attached is in electrical contact therewith. Disadvantageously, the legs of the bypass element engage in the slots of the selected insulation displacement contact elements and practically close them altogether. It is then no longer possible to introduce cable into and contact these insulation displacement contact elements so that the connection options and contact variants of the electrical plug-in connector are substantially reduced by this type of short-circuit bypass. It is furthermore disadvantageous that the attaching element has a complicated shape, is difficult to position, and must be provided with integrated tines in order to produce sufficient assured contact. In addition, the bypass element to be attached to the insulation displacement contact elements from above makes it difficult to close the housing of the connector with a cover.

Proceeding thereform, it is an object of the present invention to provide an easy-to-use short-circuit bypass with which the contact options for the connector are not limited and which avoids the disadvantages cited in the foregoing.

SUMMARY OF THE INVENTION

This object is realized in that formed in the connection region of the contact element between the two connecting segments, in particular between the insulation displacement contact elements and the flexible tongue pair, is a recess that is laterally accessible, in that the recesses of at least two of these contact elements are interconnected b m .Uy inserting an electrically conducting bypass element in the transverse direction to produce the short-circuit bypass, and in that the bypass element is arranged in the recesses with press fit. What this achieves is that due to the laterally arranged bypass element, no regions of the contact element that are provided from the housing for cable contact are closed by the bypass element, so that the teaching of the invention does not limit the contact options for the plug-in connector. Using the bypass element by means of pressing it in transversely is very simple and absolutely assures contact due to the force fit. The shape and manufacture of the short-circuit bypass can be designed to be extremely economical and technically effective. The disadvantages of the prior art as cited in the foregoing are eliminated entirely.

Further useful embodiments and advantageous further developments of the subject of the invention are described subsequently.

BRIEF DESCRIPTION OF THE DRAWINGS

Details and advantages of the invention result from the following description of the accompanying schematic drawings, in which a preferred embodiment of an electrical plug-in cable connector and its parts are illustrated, and in which.

DESCRIPTION OF PREFERRED EMBODIMENTS

Figure 1:
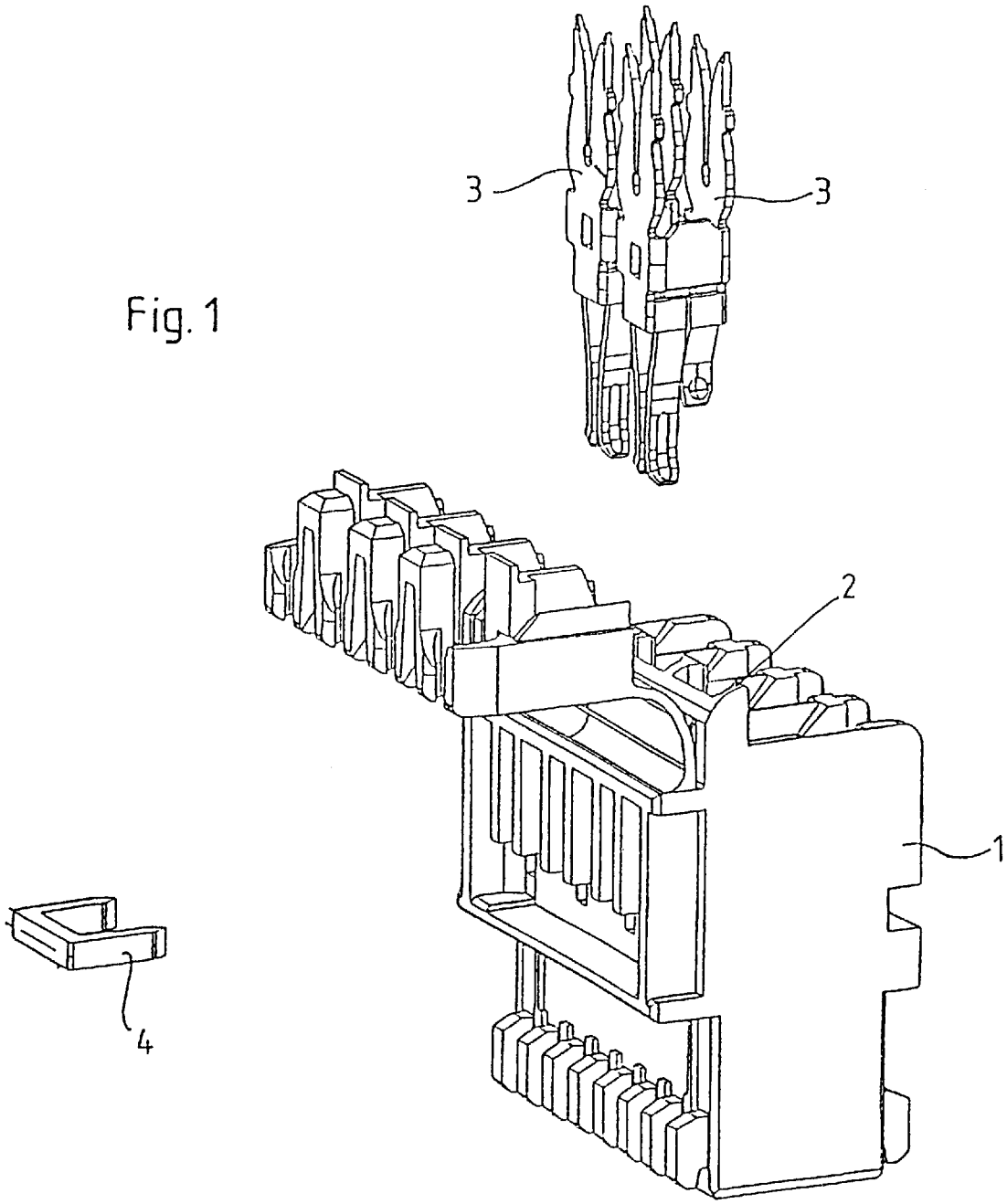
FIG. 1 is an exploded perspective view of the elements of an electrical cable plug-in connector.

FIG. 1 is an exploded illustration of all of the parts of an electrical cable plug-in connector, i.e., an empty plastic housing 1 with a plurality of chambers 2 arranged in a row for a corresponding number of contact elements 3 and a short-circuit bypass 4.

Figure 2:
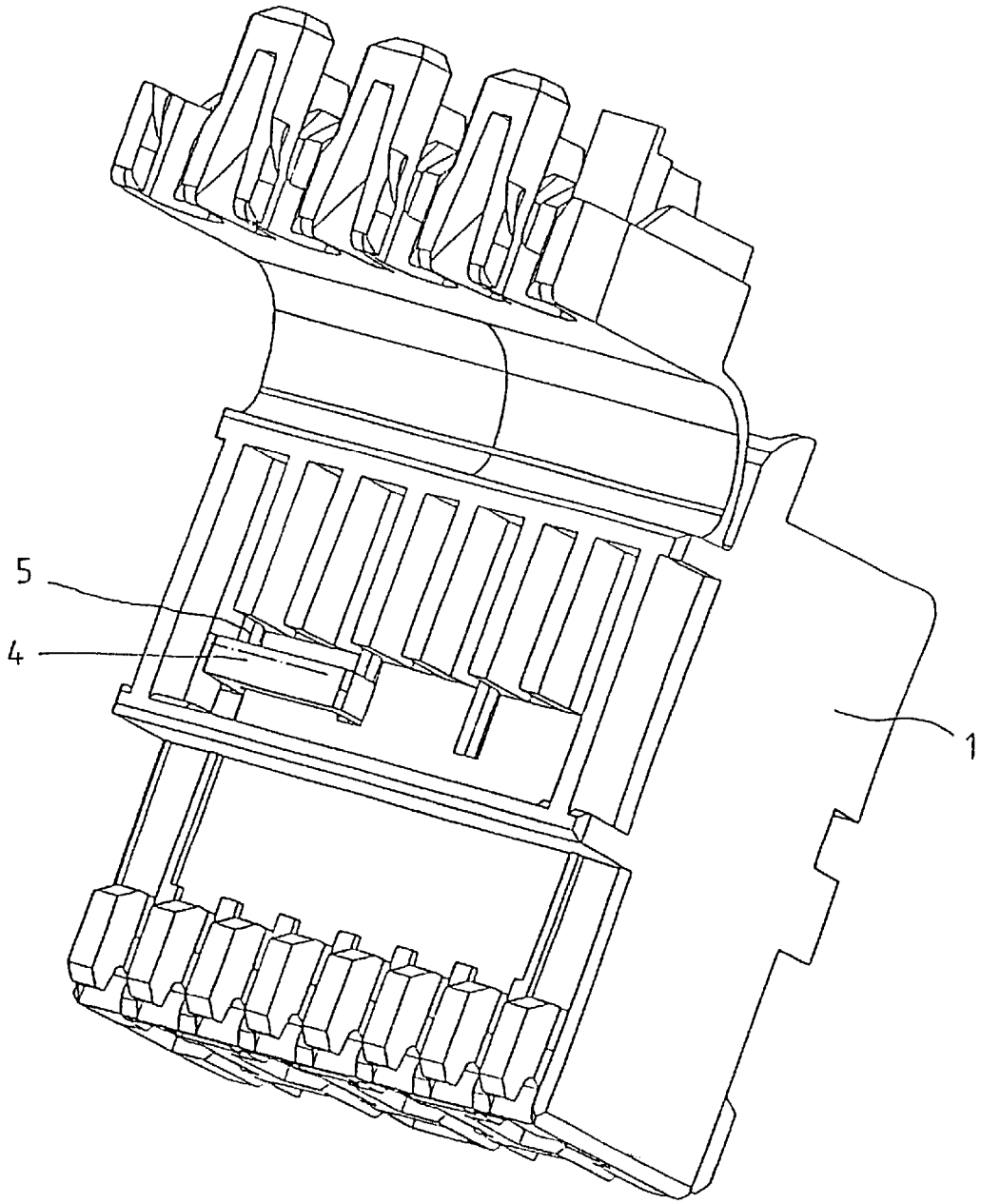
FIG. 2 is a perspective view of the connector in FIG. 1 in its assembled condition.

FIG. 2 illustrates the connector of FIG. 1 in the finished, assembled condition with open housing cover. Inserted in each chamber 2 of the plastic housing 1 is a contact element 3, and the short-circuit bypass 4 is inserted through recesses 5 of the plastic housing 1 into the two chambers on the left in the illustration that have the inserted contact elements such that these two contact elements are mutually electrically connected in that the chamber wall of the plastic housing therebetween that insulatingly separates is bypassed. Additional details about the structure of the contact elements 3 and short-circuit bypass 4 result from the following description of FIGS. 3 through 5.

Figure 3:
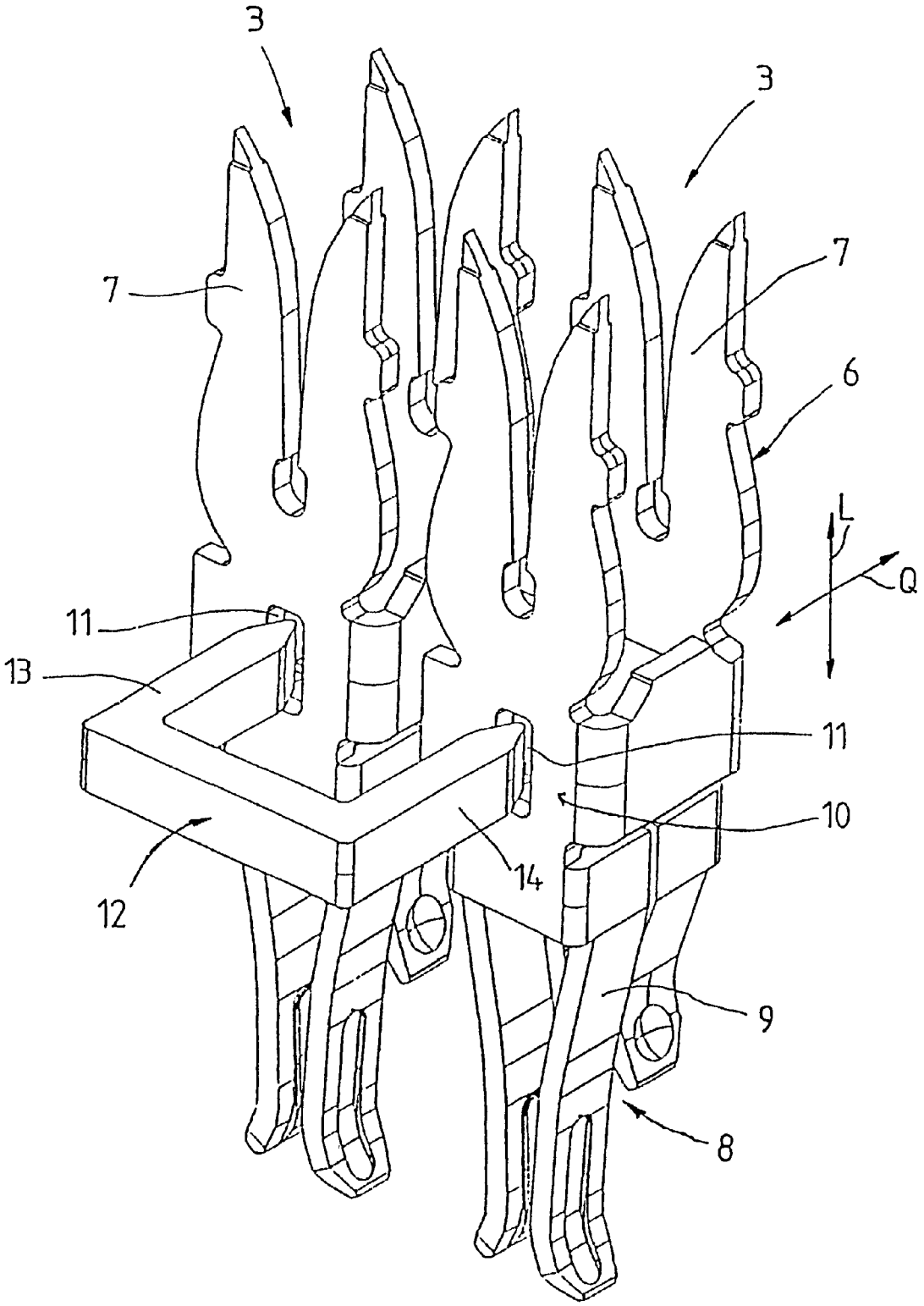
FIG. 3 illustrates two contact elements of the connector of FIGS. 1 and 2 in a perspective view and with a short-circuit bypass that has not yet been positioned.

FIG. 3 is a perspective illustration of two contact elements 3 in an arrangement mutually adjacent in a row. It is the same arrangement in which they are inserted in the associated chambers 2 of the plastic housing 1 and then are insulatingly separated from each other by the chamber walls. Viewed from the longitudinal direction L, each contact element 3 has on its upper side in the drawing a first connecting segment 6, namely insulation displacement contacts 7, for bare connection of a cable (not shown), and on the opposing side has a second connecting segment 8, namely a flexible tongue pair 9, for connecting a plug contact pin or a printed track or conductor strip. The two connecting segments 6 and 8 are mutually joined approximately centrally by a connection region 10 in which is formed a recess 11 that extends transversely, centrally, and approximately perpendicular thereto. A U-shaped bypass element 12 can be pressed into the two recesses 11 of the two contact elements 3 from the side in the transverse direction Q, which produces a mutually electrically conducting connection between the two contact elements 3 and thus constitutes a short-circuit bypass. The relationship to the housing 1 cannot be seen in the drawing in FIG. 3, but can be seen in the drawing in FIG. 2. The bypass element 12 passes through the plastic housing 1 from the exterior and through the two lateral recesses 5, and the free legs 13, 14 extend as contact arms into the interior of the adjacent chambers 2 and then engage in the recesses 11 of the two contact elements 3 in FIG. 3 for the purpose of producing a conducting connection. The bypass element 12 must be pressed into the recesses 11 since the corresponding dimensions of the free legs 13 and 14 and of the recess 11 constitute a press fit.

Figure 4:
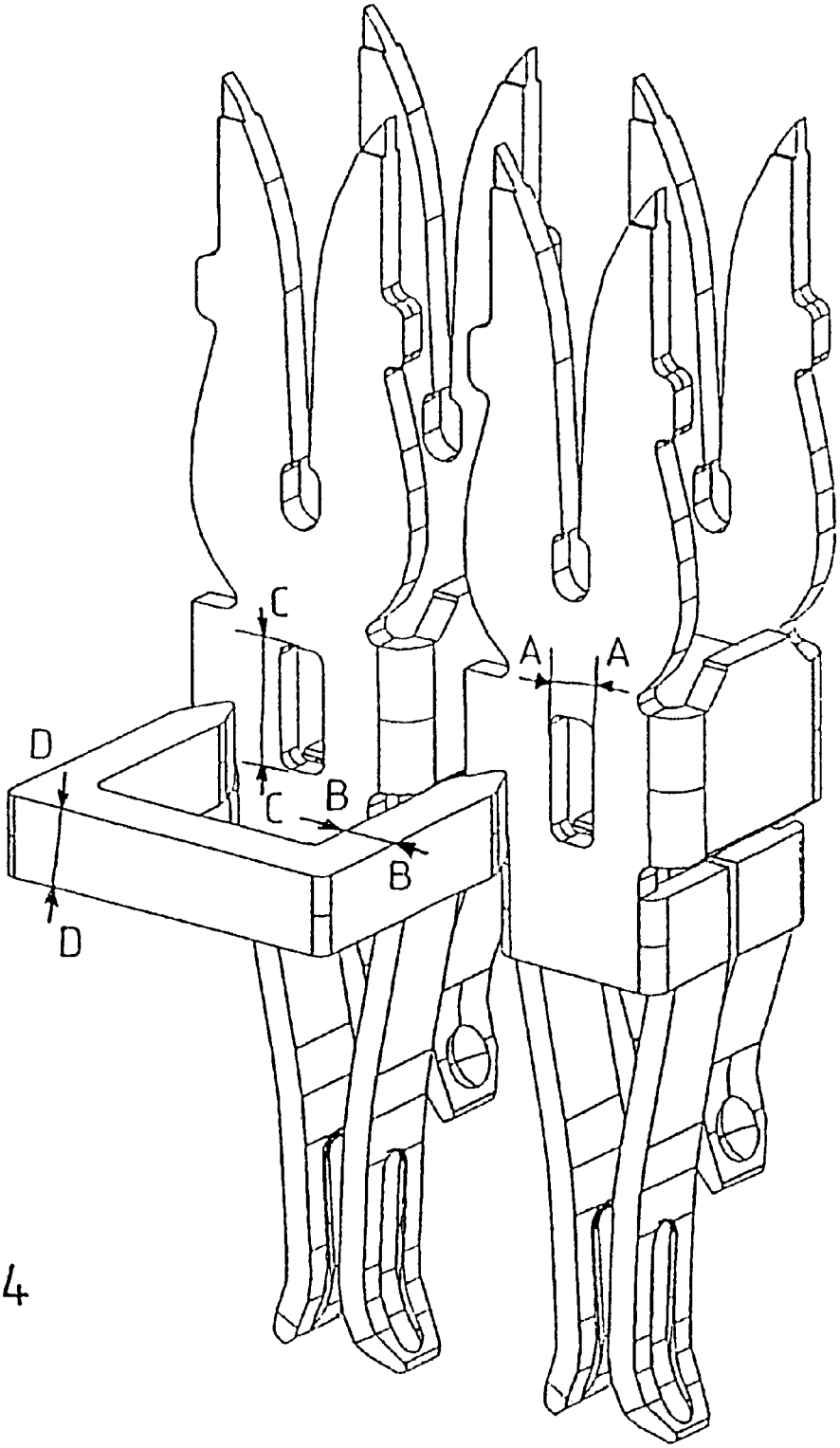
FIG. 4 illustrates the contact elements of FIG. 3 with additional reference letters to clarify the options for achieving a force fit in the contacting of the short-circuit bypass.

The drawing in FIG. 4 clarifies the options for producing the press fit via correctly proportioned dimensions A—A of the recesses and B—B of the free legs 13 and 14 of the bypass element or also via correctly proportioned dimensions C—C of the recesses 11 and dimension D—D of the bypass element 12. It is also possible to combine the two alternatives. To make it easier to press the bypass element 12 in the transverse direction into the recesses 11, the free ends of the bypass element 12 that lead with the pressing motion are slanted. Furthermore, the dimension D—D is designed such that it is possible to test the contact and short-circuit by means of a testing pin.

Figure 5:
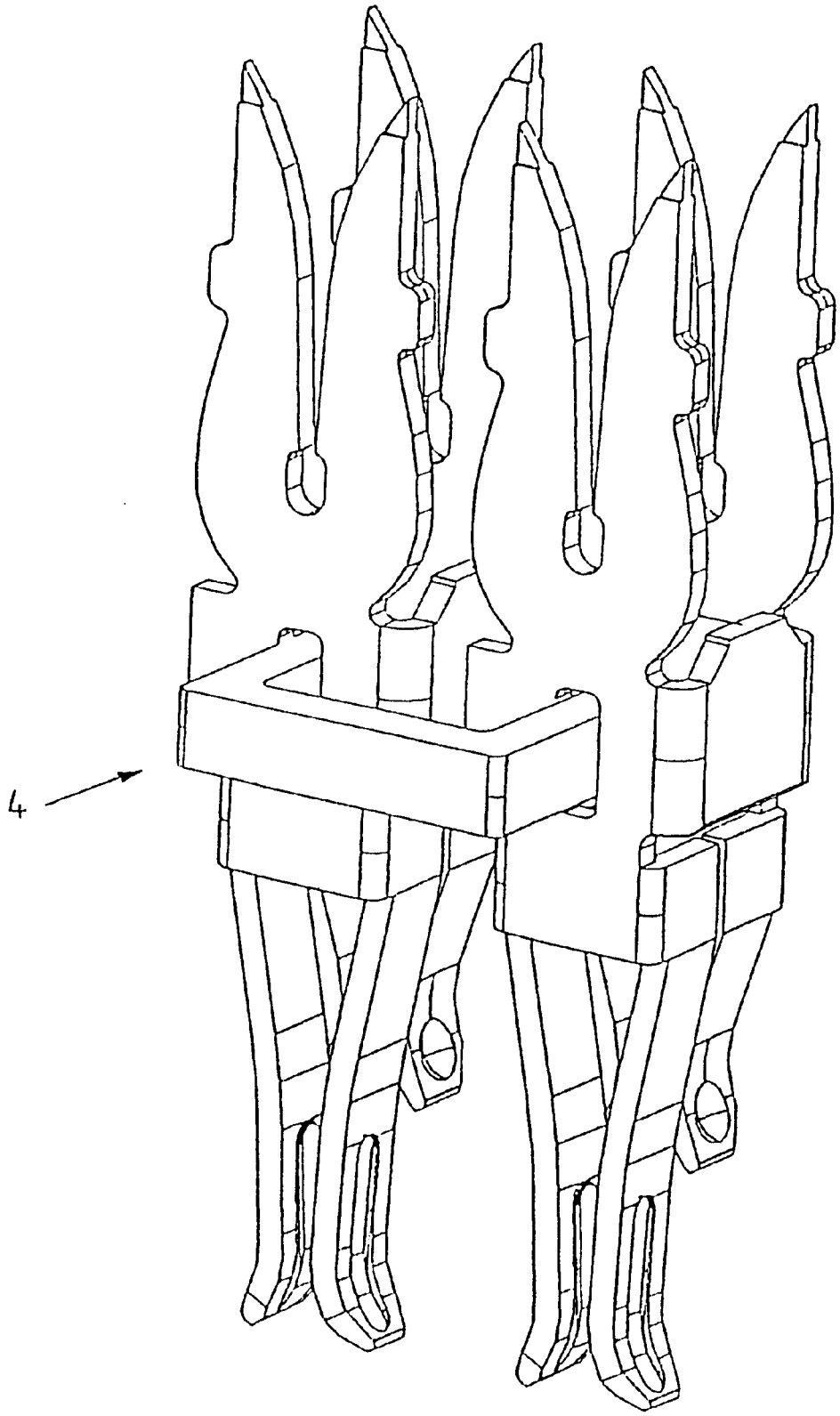
FIG. 5 illustrates the contact elements of FIGS. 3 and 4 with an installed short-circuit bypass.

The drawing in FIG. 5 illustrates the assembled short-circuit bypass 4 at the two contact elements 3; the plastic housing 1 is not shown.

The specification incorporates by reference the disclosure of German priority document 299 10 867.8 of Jun. 28, 1999.

The present invention is, of course, in no way restricted to the specific disclosure of the specification and drawings, but also encompasses any modifications within the scope of the appended claims.

What we claim is:

1. An electrical plug-in cable connector comprising:

a plastic housing having chambers disposed in a row, said housing including at least one lateral recess;

contact elements disposed in said chambers, wherein each of said contact elements has a first end that is provided with a first connecting segment, a second opposite end that is provided with a second connecting segment, and a connection region disposed between the first and second connecting segments wherein a recess having a rectangular configuration is provided in said connection region and positioned to be aligned with one of said at least one lateral recess of said housing, and wherein said recess is laterally accessible transverse to said longitudinal direction through said one of said at least one lateral recess of said housing; and an electrically conducting bypass element for insertion with press fit in a transverse direction into said at least one lateral recess of said housing and at least two of said recesses of said contact elements to interconnect those contact elements to establish a short-circuit bypass between such contact elements, wherein free legs of said bypass element are rod-shaped and have a rectangular cross-sectional configuration in correspondence to said rectangularly configured recess, and wherein free insertion ends of said free legs are inclined to facilitate insertion.

2. A cable connector according to claim 1, wherein a geometrical shape of said recess corresponds with free legs of said bypass element in such a way that said short-circuit bypass is effected by contact accompanied by press fit.

3. A cable connector according to claim 1, wherein said bypass element has a U-shaped configuration.

4. A cable connector according to claim 1, wherein to establish a short-circuit bypass of a plurality of said contact elements, a plurality of U-shaped bypass elements are disposed next to one another and on the whole form a comb-shaped bypass element.

5. A cable connector according to claim 1, wherein said bypass element is a monolithic component stamped from a rectangular element.

6. A cable connector according to claim 1, which can be used as a direct and indirect connector.

* * * * *